US011490779B2

(12) United States Patent
Digman et al.

(10) Patent No.: US 11,490,779 B2
(45) Date of Patent: Nov. 8, 2022

(54) DISHWASHER WITH MULTI-LEVEL DISHWASHER RACK

(71) Applicant: Midea Group Co., Ltd., Foshan (CN)

(72) Inventors: Robert M. Digman, Goshen, KY (US); Mark W. Wilson, Simpsonville, KY (US); Garen Gibbs, Zionsville, IN (US)

(73) Assignee: MIDEA GROUP CO., LTD., Guangdong (CN)

( * ) Notice: Subject to any disclaimer, the term of this patent is extended or adjusted under 35 U.S.C. 154(b) by 207 days.

(21) Appl. No.: 16/913,890

(22) Filed: Jun. 26, 2020

(65) Prior Publication Data

US 2021/0401257 A1 Dec. 30, 2021

(51) Int. Cl.
*A47L 15/23* (2006.01)
*A47L 15/50* (2006.01)
(Continued)

(52) U.S. Cl.
CPC ..... *A47L 15/23* (2013.01); *A47L 15/508* (2013.01); *A47L 15/22* (2013.01); *A47L 15/4221* (2013.01);
(Continued)

(58) Field of Classification Search
CPC .... A47L 15/23; A47L 15/4282; A47L 15/508; A47L 15/22; A47L 15/503; A47L 15/507; A47L 15/4221
See application file for complete search history.

(56) References Cited

U.S. PATENT DOCUMENTS 1,928,683 A * 10/1933 Cammann, Jr. ..... A47L 15/20 134/175
2,751,917 A * 6/1956 Low ..... A47L 15/4225 134/191
(Continued)

FOREIGN PATENT DOCUMENTS

CN 106714646 A 5/2017
CN 209285415 U 8/2019
(Continued)

OTHER PUBLICATIONS

Venetio, Venetio Deluxe Aluminum Dish Drying Rack 2 Tiers, www.amazon.com, 2020.
(Continued)

*Primary Examiner* — Benjamin L Osterhout
(74) *Attorney, Agent, or Firm* — Middleton Reutlinger

(57) ABSTRACT

A dishwasher may utilize a multi-level dishwasher rack that in some instances may be reconfigurable into different configurations to optimize the rack for different types and/or combinations of utensils. A movable divider may be used in some instances to selectively expose a deep portion of a rack, and a drawer may be used in some instances to provide access utensils stored underneath a divider. A movable portion of a bottom of a rack may also be used in some instances to provide different support surfaces in the rack at different elevations. A tubular spray element or another rotatable spray tube may also be positioned relative to a multi-level dishwasher rack in some instances to facilitate concentrated washing of different facing surfaces of different utensils stored in the rack.

24 Claims, 6 Drawing Sheets

(51) Int. Cl.
*A47L 15/42* (2006.01)
*A47L 15/22* (2006.01)

(52) U.S. Cl.
CPC ..... *A47L 15/4282* (2013.01); *A47L 15/503* (2013.01); *A47L 15/507* (2013.01)

(56) References Cited

U.S. PATENT DOCUMENTS 3,044,842 A * 7/1962 Mercer ..... B29C 33/0033 312/228.1
3,181,924 A 5/1965 Guth
3,361,361 A * 1/1968 Schutte ..... A47L 15/23 134/179
4,606,464 A * 8/1986 Jordan ..... A47L 15/503 211/184
5,158,185 A * 10/1992 Michael ..... A47L 15/503 211/151
5,205,419 A * 4/1993 Purtilo ..... A47L 15/505 211/151
5,954,073 A 9/1999 Tobbe et al.
7,032,604 B2 4/2006 Welch
7,493,905 B2 2/2009 Jeong et al.
7,909,046 B2 3/2011 Kim et al.
8,163,103 B2 * 4/2012 Shin ..... A47L 15/502 134/84
8,287,660 B2 * 10/2012 Chen ..... A47L 15/42 134/198
10,092,160 B2 * 10/2018 Ju ..... A47L 15/23
10,362,923 B2 7/2019 Thiyagarajan
10,512,385 B2 12/2019 Tuller et al.
10,531,781 B2 1/2020 Digman et al.
2003/0226580 A1 12/2003 Welch
2007/0215187 A1 9/2007 Koch et al.
2011/0133614 A1 * 6/2011 Bastuji ..... A47L 15/507 312/228.1
2011/0233158 A1 * 9/2011 Haider ..... A47L 15/503 211/41.8
2015/0090306 A1 * 4/2015 Boyer ..... A47L 15/23 134/184
2016/0106295 A1 * 4/2016 Thiyagarajan ..... A47L 15/4282 134/182
2018/0220867 A1 8/2018 Carr et al.
2019/0099054 A1 4/2019 Digman et al.
2019/0290094 A1 * 9/2019 Balinski ..... A47L 15/50
2019/0290097 A1 * 9/2019 Naik ..... A47L 15/4282

FOREIGN PATENT DOCUMENTS

EP 0727182 A2 8/1996
GB 2359248 A 8/2001
JP H09271460 A 10/1997
KR 20120140503 A 12/2012
KR 20180091140 A 8/2018

OTHER PUBLICATIONS

International Search Report and Written Opinion issued in application No. PCT/CN2021/102147, dated Sep. 27, 2021, 10 pages.

* cited by examiner

DISHWASHER WITH MULTI-LEVEL DISHWASHER RACK

BACKGROUND

Dishwashers are used in many single-family and multi-family residential applications to clean dishes, silverware, cutlery, cups, glasses, pots, pans, etc. (collectively referred to herein as "utensils"). Due to the wide variety of items that may need to be cleaned by a dishwasher, many dishwashers provide various containers and/or specialized sprayers to address different washing needs. Many dishwashers, for example, include multiple sliding racks including arrangements of tines that can be used to separate and orient dishes, bowls, glasses, etc. to receive directed sprays of fluid from one or more rotating wash arms. In addition, many dishwashers include removable silverware baskets that may be positioned in dedicated locations on racks, and in some dishwashers, directed sprays are provided to provide deeper cleaning. Other dishwashers include dedicated high pressure spray zones to direct additional spraying power at particularly soiled items. Despite these various dedicated washing features, however, conventional dishwashers still lack flexibility in terms of address different consumer washing needs, including, for example, handling different types of loads with different combinations and sizes of utensils.

SUMMARY

The herein-described embodiments address these and other problems associated with the art by providing a multi-level dishwasher rack that in some instances may be reconfigurable into different configurations to optimize the rack for different types and/or combinations of utensils. A movable divider may be used in some instances to selectively expose a deep portion of a rack, and a drawer may be used in some instances to provide access utensils stored underneath a divider. A movable portion of a bottom of a rack may also be used in some instances to provide different support surfaces in the rack at different elevations. A tubular spray element or another rotatable spray tube may also be positioned relative to a multi-level dishwasher rack in some instances to facilitate concentrated washing of different facing surfaces of different utensils stored in the rack.

Therefore, consistent with one aspect of the invention, a dishwasher may include a wash tub, a fluid supply configured to supply fluid to the wash tub, a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, the deep portion of the rack sized to receive taller utensils than the shallow portion of the rack, a tubular spray element disposed in the wash tub proximate the rack and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures, and a tubular spray element drive coupled to the tubular spray element and configured to discretely direct the tubular spray element to each of a plurality of rotational positions about the longitudinal axis thereof, the tubular spray element drive configured to discretely direct the tubular spray element to direct fluid upwardly into the rack from beneath the upper portion of the bottom of the rack to spray a downwardly-facing surface of a first utensil supported in the shallow portion of the rack, and to discretely direct the tubular spray element to direct fluid laterally into the rack and towards the deep portion of the rack to spray a laterally-facing surface of a second utensil supported in the deep portion of the rack.

Further, in some embodiments, the bottom of the rack further includes an intermediate wall extending between the upper and lower portions and in a generally transverse direction, a junction between the intermediate wall and the upper portion of the bottom of the rack forming a corner, the tubular spray element is disposed proximate the corner, and the tubular spray element directs fluid through the intermediate wall when spraying the laterally-facing surface of the second utensil. In addition, in some embodiments, the intermediate wall extends in a substantially vertical direction.

Further, in some embodiments, the tubular spray element is a first tubular spray element, and the dishwasher further includes a second tubular spray element disposed in the wash tub underneath the upper portion of the bottom of the rack and positioned to spray upwardly into the rack from beneath the upper portion of the bottom of the rack, and a third tubular spray element disposed in the wash tub underneath the lower portion of the bottom of the rack and positioned to spray upwardly into the rack from beneath the lower portion of the bottom of the rack. Moreover, in some embodiments, the tubular spray element is mounted to a wall of the wash tub. Further, in some embodiments, the tubular spray element is supported by the rack.

Some embodiments may also include a controller coupled to the tubular spray element drive, the controller configured to, during a portion of a wash cycle, control the tubular spray element drive to discretely direct the tubular spray element to direct fluid upwardly into the rack from beneath the upper portion of the bottom of the rack to provide concentrated washing of the downwardly-facing surface of the first utensil. In addition, some embodiments may further include a controller coupled to the tubular spray element drive, the controller configured to, during a portion of a wash cycle, control the tubular spray element drive to discretely direct the tubular spray element to direct fluid laterally into the rack and towards the deep portion of the rack to provide concentrated washing of the laterally-facing surface of the second utensil.

Consistent with another aspect of the invention, a dishwasher may include a wash tub, a fluid supply configured to supply fluid to the wash tub, a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack and joined by an intermediate wall extending therebetween and in a generally transverse direction, a junction between the intermediate wall and the upper portion of the bottom of the rack forming a corner, and the deep portion of the rack sized to receive taller utensils than the shallow portion of the rack, a rotatable spray tube disposed in the wash tub proximate the corner formed by the junction between the intermediate wall and the upper portion of the bottom of the rack, the rotatable spray tube being rotatable about a longitudinal axis thereof and including one or more apertures extending through an exterior surface thereof, and the rotatable spray tube in fluid communication with the fluid supply to direct fluid from the fluid supply into the wash tub through the one or more apertures. The rotatable spray tube is positioned to direct fluid upwardly into the rack from beneath the upper portion of the bottom of the rack to spray a downwardly-facing surface of a first utensil supported in the shallow portion of the rack when rotated to a first rotational position, and to direct fluid laterally into the rack through the intermediate wall and towards the deep portion of the rack to spray a laterally-facing surface of a second utensil supported in the deep portion of the rack when rotated to a second rotational position.

Further, in some embodiments, the rotatable spray tube is a tubular spray element, and the dishwasher further includes a tubular spray element drive coupled to the tubular spray element and configured to discretely direct the tubular spray element to each of a plurality of rotational positions about the longitudinal axis thereof. In addition, in some embodiments, the rotatable spray tube rotates in reaction to fluid exiting the one or more apertures. Also, in some embodiments, the rotatable spray tube rotates in an uncontrolled manner.

Consistent with another aspect of the invention, a dishwasher may include a wash tub, a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, the deep portion of the rack sized to receive taller utensils than the shallow portion of the rack, and the deep portion of the rack further defining an opening at least partially circumscribed by the upper portion of the bottom of the rack, and a movable divider disposed in the rack and movable between first and second positions. In the first position, the divider extends across at least a portion of the opening to support one or more utensils on the divider while permitting one or more utensils to be supported by the lower portion of the bottom of the rack underneath the divider, and in the second position, the divider exposes the opening to support one or more utensils that extend above the opening when the divider is located when in the first position.

Moreover, in some embodiments, the divider is pivotable about a substantially horizontal axis. In some embodiments, the divider defines a substantially planar and substantially horizontal support surface when in the first position. Further, in some embodiments, the divider is configured to extend at a substantially similar elevation to the upper portion of the bottom of the rack when in the first position. Also, in some embodiments, the substantially horizontal axis extends along a border between the deep and shallow portions of the rack.

Further, in some embodiments, the divider is sized to fully span the opening when in the first position and the rack is configured to support a free end of the divider opposite the substantially horizontal axis. Also, in some embodiments, the divider is configured to overlay at least a portion of the upper portion of the bottom of the rack when in the second position. In addition, in some embodiments, the divider is configured to extend downwardly into the deep portion of the rack when in the second position. Moreover, in some embodiments, the divider is slidable between the first and second positions. In some embodiments, the divider is extendible to fully span the opening when in the first position. Also, some embodiments may further include a drawer slidably received by the deep portion of the rack and configured to provide access to one or more utensils supported underneath the movable divider when the movable divider is in the first position.

Consistent with another aspect of the invention, a dishwasher may include a wash tub, a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, a divider disposed in the rack and configured to extend across at least a portion of the deep portion of the rack to support one or more utensils on the divider, and a drawer slidably received by the deep portion of the rack and configured to provide access to one or more utensils underneath the divider.

In some embodiments, the deep portion of the rack is sized to receive taller utensils than the shallow portion of the rack, the deep portion of the rack further defines an opening at least partially circumscribed by the upper portion of the bottom of the rack, the divider is a movable divider that is movable between first and second positions. In the first position, the divider extends across at least a portion of the opening to support one or more utensils on the divider while permitting one or more utensils to be supported by the lower portion of the bottom of the rack underneath the divider, and in the second position, the divider exposes the opening to support one or more utensils that extend above the opening when the divider is located when in the first position. Moreover, in some embodiments, the drawer includes a bottom wall configured to support one or more utensils. Further, in some embodiments, the divider is disposed at a substantially similar elevation as the upper portion of the bottom of the rack. In some embodiments, the drawer defines the lower portion of the bottom of the rack.

Consistent with another aspect of the invention, a dishwasher may include a wash tub, a multi-level rack disposed in the wash tub and configured to support a plurality of utensils to be washed, the rack configured to move between loading and washing positions, and the rack including a bottom and a plurality of side walls, the bottom of the rack including a fixed portion and a movable portion that is movable relative to the fixed portion, the fixed portion of the bottom configured to support one or more utensils at a predetermined elevation and the movable portion movable between first and second configurations. When in the first configuration the movable portion is configured to support one or more utensils at a first elevation and when in the second configuration the movable portion is configured to support one or more utensils at a second elevation that is different from the first elevation.

Also, in some embodiments, the first elevation is substantially similar to the predetermined elevation, and the second elevation is lower than the first elevation to define a deep portion of the rack sized to receive taller utensils than a shallow portion of the rack including the fixed portion of the bottom of the rack. Moreover, in some embodiments, the movable portion has a support member configured to support one or more utensils and including opposing first and second sides, the movable portion is removably coupled to the rack, when in the first configuration, the movable portion is coupled to the rack with the first side of the support member facing upwardly, and when in the second configuration, the movable portion is coupled to the rack with the second side of the support member facing upwardly. In addition, in some embodiments, the movable portion is slidably coupled to the rack to slide along a generally horizontal direction.

Also, in some embodiments, the movable portion includes a hinged member configured to pivot between the first and second configurations. In some embodiments, the hinged member is substantially horizontal in the first configuration to support one or more utensils at the first elevation, and is substantially vertical in the second configuration. In addition, in some embodiments, the hinged member is a first hinged member and the movable portion includes a second hinged member coupled to the first hinged member, and the second hinged member is substantially vertical in the first configuration and substantially horizontal in the second configuration to support one or more utensils at the second elevation. Also, in some embodiments, the first and second hinged members are rotatably coupled to one another. In some embodiments, the first and second hinged members are removably coupled to one another. Moreover, in some embodiments, at least one of the first and second hinged members is removably coupled to the rack.

In some embodiments, the movable portion is configured to be moved substantially linearly between the first and second elevations. Also, in some embodiments, the movable portion is slidably coupled to the rack to slide along a generally vertical axis.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
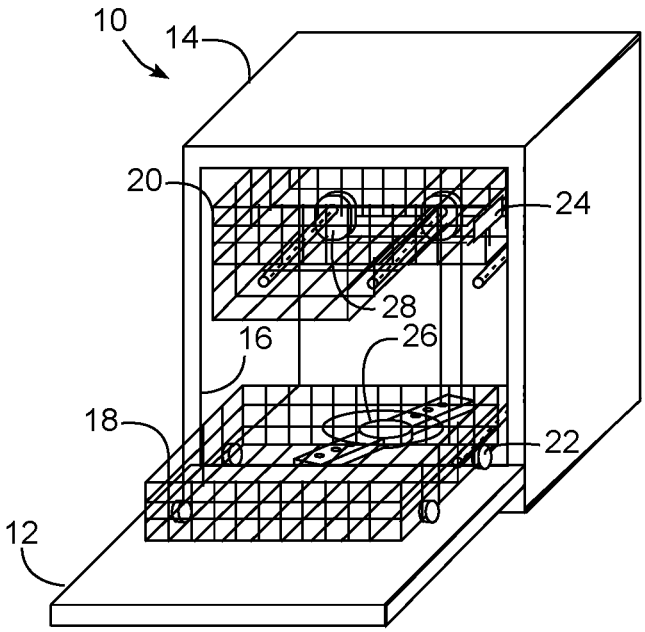
FIG. 1 is a perspective view of a dishwasher consistent with some embodiments of the invention.

In some embodiments consistent with the invention, a multi-level dishwasher rack is utilized within a dishwasher to support different combinations and/or sizes of utensils. In addition, in some embodiments, a multi-level dishwasher rack may be used in combination with a rotatable spray tube such as a tubular spray element disposed proximate a corner formed between shallow and deep portions a multi-level dishwasher rack to provide for both generally upward spray into the shallow portion of the rack as well as generally lateral spray into the deep portion of the rack.

A multi-level dishwasher rack, in this regard, may be considered to be a slidable or otherwise movable component within a dishwasher that is capable of supporting utensils, and moreover, that includes multiple "levels" capable of supporting utensils. As will become more apparent below, a multi-level dishwasher rack in some embodiments may include one or more shallow portions and one or more deep portions, with each shallow portion having a relatively smaller height or vertical direction capable of accommodating utensils than each deep portion, such that a deep portion is generally capable of accommodating relatively taller utensils than a shallow portion. It will be appreciated that in the context of the disclosure, whether or not a utensil is taller or shorter is based upon a length of the utensil in a generally vertical direction extending upward from the bottom of the rack at a particular location, and additionally based on the particular orientation of the utensil within the rack, so a deep portion of a multi-level rack is able to fit some utensils in a particular orientation that, if placed in a shallow portion in the same or a similar orientation, would cause the utensils to at least extend above a top edge of the rack, and in some instances, to extend so far as to not fit when the rack is moved into a washing position due to other structures above the rack, e.g., the bottom of a higher rack, a spray arm, or the top of the wash tub.

A multi-level dishwasher rack may include a bottom that includes one or more upper portions and one or more lower portions that respectively define shallow and deep portions of the rack. In some instances, these upper and lower portions may be generally horizontal, and in some instances with various transversely-extending intermediate walls or structures joining upper and lower portions together. In other instances, however, upper or lower portions may extend at different angles relative to horizontal, and furthermore, in some instances no intermediate walls need be provided between adjacent upper and lower portions, i.e., the upper and lower portions may be contiguous portions of a single surface. Furthermore, it will be appreciated that, given that many dishwasher racks may be formed of coated wire or plastic forms having numerous apertures through which to spray wash fluid and/or various tines or bends suitable for restricting the movement of utensils supported by the rack, the directions at which upper and lower portions of a rack extend, and the surfaces defining those directions, may not be contiguous and may include various structures creating variations on the surfaces, e.g., in the case of various wires and bends in a wire rack structure. Thus, in some instances, the direction in which a surface extends may be based upon the surface as a whole, rather than upon individual elements making up various aspects of the surface.

A rotatable spray tube may be considered to be an elongate body including one or more apertures or nozzles disposed thereon to spray a fluid such as water, a wash fluid including water, detergent and/or another treatment composition, or pressurized air, onto utensils within a wash tub, and further capable of rotating about a longitudinal axis thereof. One particular type of rotatable spray tube utilized in some embodiments of the invention is referred to herein as a tubular spray element, which may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. A tubular spray element may also have a cross-sectional profile that varies along the longitudinal axis, so it will be appreciated that a tubular spray element need not have a circular cross-sectional profile along its length. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. As will also become more apparent below, upper rack 20 is configured as a multi-level dishwasher rack having deep and shallow portions suitable for supporting utensils of differing heights. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, dishwasher 10 may include various sprayers, including, for example, a rotatable spray arm 26 disposed below lower rack 18 and one or more tubular spray elements (TSEs) 28 disposed below upper rack 20 to direct a wash fluid onto utensils disposed in racks 18, 20. As will become more apparent below, tubular spray elements 28 are rotatable about respective longitudinal axes and are discretely directable by one or more tubular spray element drives (not shown in FIG. 1) to control a direction at which fluid is sprayed by each of the tubular spray elements.

In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention. Some tubular spray elements 28 may be fixedly mounted to a wall or other structure in wash tub 16, while other tubular spray elements 28 may be supported by a rack 18, 20 and may be removably coupled to a docking arrangement mounted to a wall of wash tub 16. Further, while the tubular spray elements 28 disclosed herein may be discretely directable via tubular spray element drives, in other embodiments, non-discretely directable spray tubes, e.g., driven by an electric or hydraulic motor or in reaction to fluid emitted from the spray tubes, may be used.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
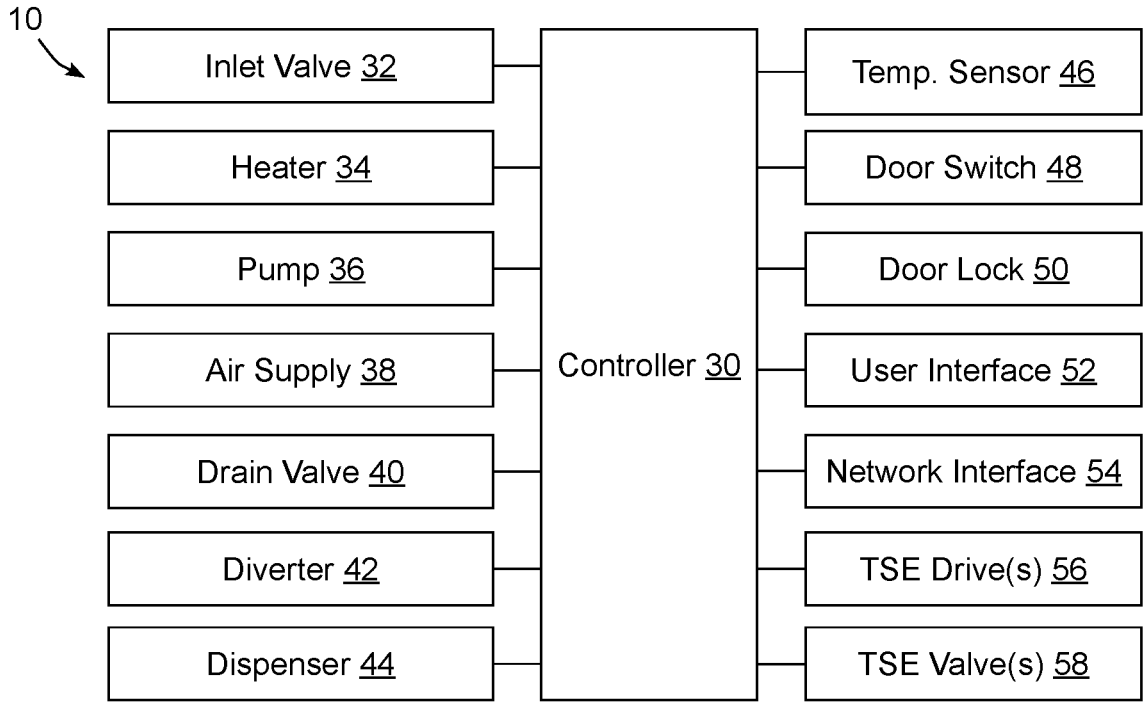
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements and other sprayers may be used solely for spraying wash fluid or spraying pressurized air, with other sprayers or spray arms used for other purposes, so the invention is not limited to the use of tubular spray elements or other sprayers for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
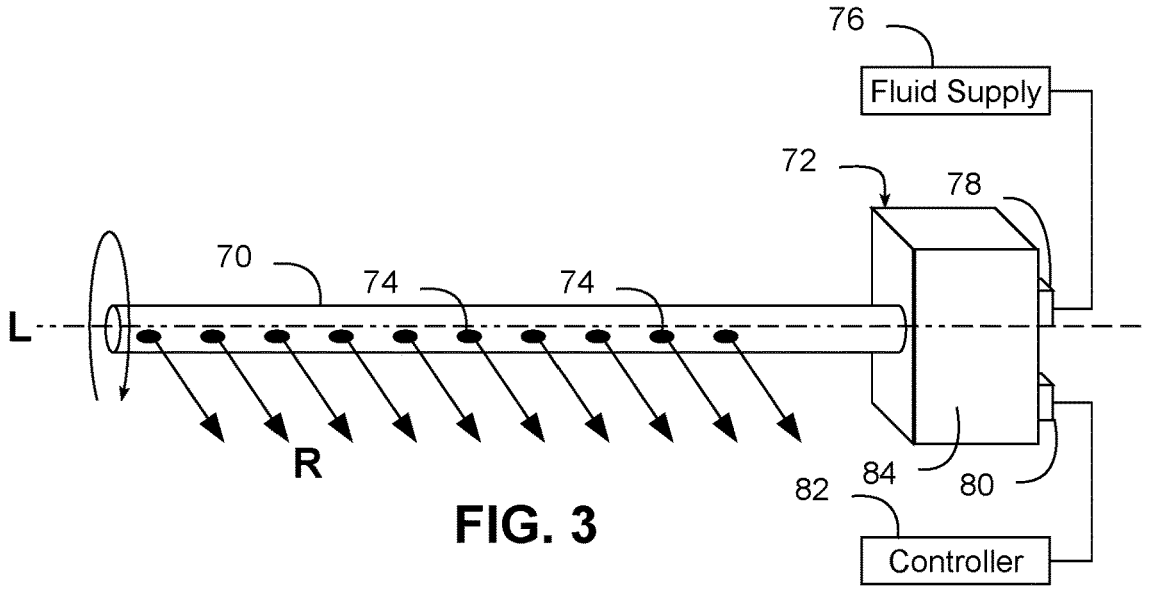
FIG. 3 is a side perspective view of a tubular spray element and tubular spray element drive from the dishwasher of FIG. 1.

Now turning to FIG. 3, in some embodiments, a dishwasher may include, in addition to multi-level dishwasher racks, one or more discretely directable tubular spray elements, e.g., tubular spray element 70 coupled to a tubular spray element drive 72. Tubular spray element 70 may be configured as a tube or other elongated body disposed in a wash tub and being rotatable about a longitudinal axis L. In addition, tubular spray element 70 is generally hollow or at least includes one or more internal fluid passages that are in fluid communication with one or more apertures 74 extending through an exterior surface thereof. Each aperture 74 may function to direct a spray of fluid into the wash tub, and each aperture may be configured in various manners to provide various types of spray patterns, e.g., streams, fan sprays, concentrated sprays, etc. Apertures 74 may also in some instances be configured as fluidic nozzles providing oscillating spray patterns.

Moreover, as illustrated in FIG. 3, apertures 74 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 70 is in fluid communication with a fluid supply 76, e.g., through a port 78 of tubular spray element drive 72, to direct fluid from the fluid supply into the wash tub through the one or more apertures 74. Tubular spray element drive 72 is coupled to tubular spray element 70 and is configured to discretely direct the tubular spray element 70 to each of a plurality of rotational positions about longitudinal axis L. By "discretely directing," what is meant is that tubular spray element drive 72 is capable of rotating tubular spray element 70 generally to a controlled rotational angle (or at least within a range of rotational angles) about longitudinal axis L. Thus, rather than uncontrollably rotating tubular spray element 70 or uncontrollably oscillating the tubular spray element between two fixed rotational positions, tubular spray element drive 72 is capable of intelligently focusing the spray from tubular spray element 70 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 72 is also illustrated with an electrical connection 80 for coupling to a controller 82, and a housing 84 is illustrated for housing various components in tubular spray element drive 72. In the illustrated embodiment, tubular spray element drive 72 may be configured as a base that supports, through a rotary coupling, an end of the tubular spray element and effectively place the tubular spray element in fluid communication with port 78.

By having an intelligent control provided by tubular spray element drive 72 and/or controller 82, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Various additional features may be added to a tubular spray element in some embodiments. For example, various gearing arrangements or other mechanical couplings may be utilized to vary a speed of rotation relative to a drive motor, and a position sensor may be incorporated into a tubular spray element or tubular spray element drive in order to track the position of the tubular spray element. Further, a valve may be disposed in the fluid supply to the tubular spray element in order to regulate the flow of fluid thereto. In addition, tubular spray elements may be mounted within a wash tub in various manners in different embodiments, e.g., mounted to a wall (e.g., a side wall, a back wall, a top wall, a bottom wall, or a door) of a wash tub, or supported by a rack and mounted in a removable manner to a fluid supply disposed on a wall or door of the wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Tubular spray element drives may drive individual tubular spray elements in some embodiments, while in other embodiments a single tubular spray element drive may drive multiple tubular spray elements.

In addition, in some embodiments, other types of spray arms and/or other sprayers may be used, whether in combination with or in lieu of tubular spray elements. Further, while the tubular spray elements disclosed herein are discretely directable, non-discretely directable rotatable spray tubes (driven, for example, by an electric or hydraulic motor, or as a reaction to a directed flow of fluid from the spray tubes) may be used in some embodiments. Further details regarding tubular spray elements may be found, for example, in U.S. Pat. No. 10,531,781 to Digman et al., which is assigned to the same assignee as that of the present application, and which is incorporated by reference herein.

Multi-Level Dishwasher Rack

Figure 4:
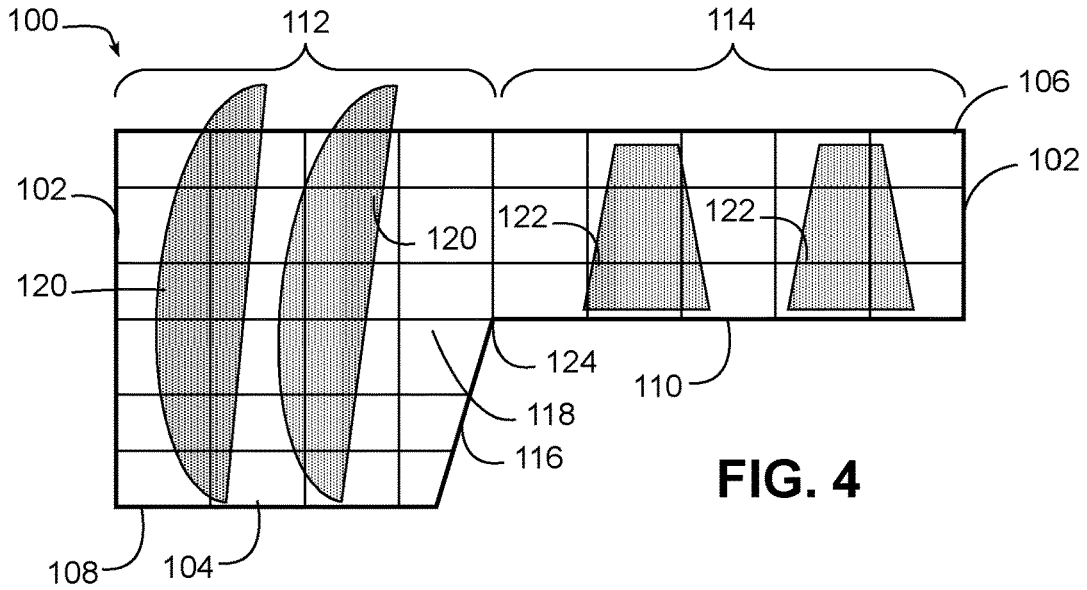
FIG. 4 is a front elevational view of a multi-level dishwasher rack consistent with some embodiments of the invention.
Figure 5:
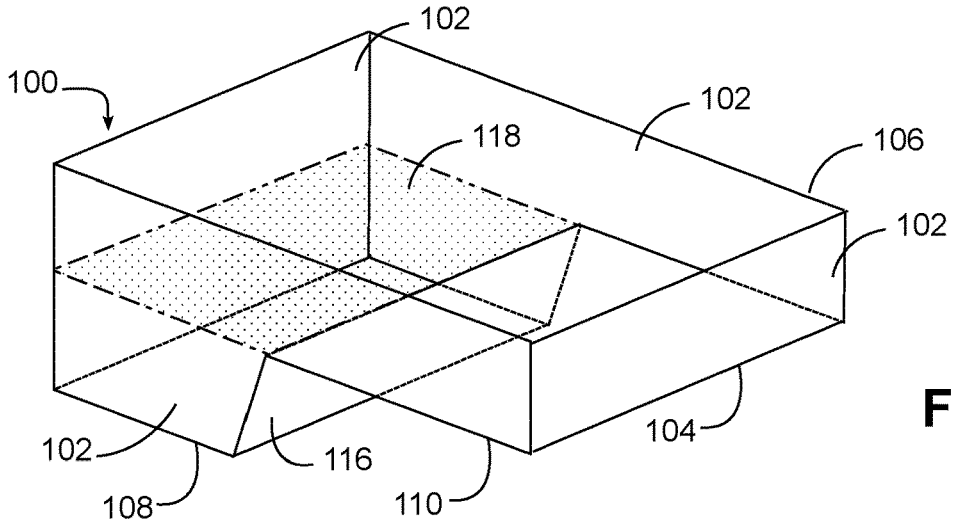
FIG. 5 is a functional perspective view of the multi-level dishwasher rack of FIG. 4.

Now turning to FIGS. 4-5, an example multi-level dishwasher rack 100, suitable for use, for example, as upper rack 20 of dishwasher 10 of FIGS. 1-2, may be used in some embodiments to provide added flexibility and increased space efficiency within a dishwasher. Rack 100 in the illustrated embodiment includes a plurality of side walls 102, a bottom 104, and a top edge 106, and in some embodiments may be formed of coated wire, plastic, metal, or combinations thereof as will be appreciated by those of ordinary skill having the benefit of the instant disclosure. Moreover, while rack 100 in the illustrated embodiment is an upper rack, in other embodiments, a multi-level rack may be used as a lower rack, or in the case of a dishwasher with more than two racks, as a middle rack.

Rack 100 is a multi-level rack to the extent that the bottom of the rack includes different portions disposed at different elevations within a dishwasher, e.g., a lower portion 108 and an upper portion 110. Through the use of a bottom having different elevations, rack 100 includes one or more deep portions and one or more shallow portions, e.g., deep portion 112 defined by lower portion 108 of bottom 104 and shallow portion 114 defined by upper portion 110 of bottom 104. As illustrated in FIG. 5, deep portion 112 may be considered in some embodiments to effectively define an opening 118 in upper portion 110, and as illustrated in FIG. 4, such an opening allows taller utensils 120 to be supported in the deep portion, while shorter utensils 122 may still be supported in the shallow portion. In some instances, taller utensils may still extend above top edge 106, but remain below any obstructions that may be disposed above the top edge of the rack, e.g., another rack, a spray arm, or the top of the wash tub. Furthermore, it will be appreciated that, rather than utilizing a rack that is deep throughout, a multi-level rack may also provide flexibility and space efficiency below the rack itself, e.g., to provide a greater volume for taller utensils beneath shallow portion 114 in another rack that is disposed below multi-level rack 100 (e.g., as is illustrated in FIG. 1 by upper rack 20, which has a shallow portion on the right side of the rack that provides additional volume above lower rack 18).

Furthermore, while deep and shallow portions 112, 114 are illustrated as extending fully from front to back of rack 100 and adjacent to one another in a lateral direction (i.e., from side to side), in other embodiments deep and shallow portions may be adjacent one another from front to back in addition to or in lieu of being adjacent one another from side to side. For example, in some embodiments a shallow or deep portion may occupy one quadrant of a rack (e.g., the rear left corner), with the remainder of the rack being disposed at a different elevation.

In some embodiments, bottom portions of different elevations may be joined together by one or more intermediate walls, e.g., intermediate wall 116 between upper and lower portions 108, 110, which extend in a generally transverse direction to each of portions 108, 110, and which, in some instances, may form one or more corners, e.g., corner 124, proximate to which both the bottoms of some utensils, and the sides of some utensils, may be concurrently positioned within a rack to facilitate spraying, cleaning and rinsing of different types of utensils positioned in different portions of a rack. A corner may be formed at a junction of two walls or portions that extend in different directions, although a corner may be defined in other manners in other embodiments, e.g., based upon a curved and/or concave wall, so long as the corner presents an opportunity for a sprayer disposed within the corner to spray generally horizontally into a deep portion of a rack as well as spray generally vertically into a shallow portion of a rack.

In some embodiments, an intermediate wall may extend in a generally vertical direction, while the various other portions of a rack bottom may extend in a generally horizontal direction; however, it will be appreciated that the invention is not so limited. In other embodiments, for example, an intermediate wall may extend in a non-vertical direction, e.g., as is the case for intermediate wall 116 which, while still extending mostly vertical and generally transverse to portions 108, 110, has a slope that is offset from a precisely vertical direction. Moreover, in other embodiments an upper and/or a lower portion of a rack bottom may extend in a direction that is offset from a precisely horizontal direction, and further, rack bottoms may include curved surfaces or portions in some embodiments, and intermediate walls in some embodiments may be substantially contiguous with upper and/or lower portions of a rack bottom.

Figure 6:
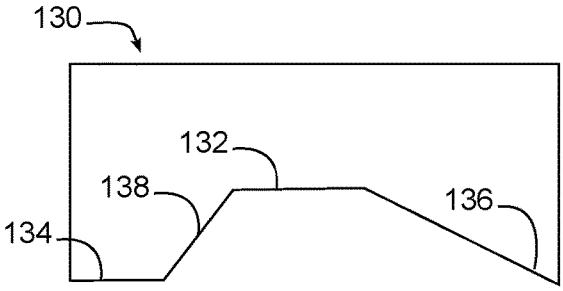
FIGS. 6-8 are functional front elevation views of other implementations of a multi-level dishwasher rack to that illustrated in FIGS. 4-5.
Figure 7:
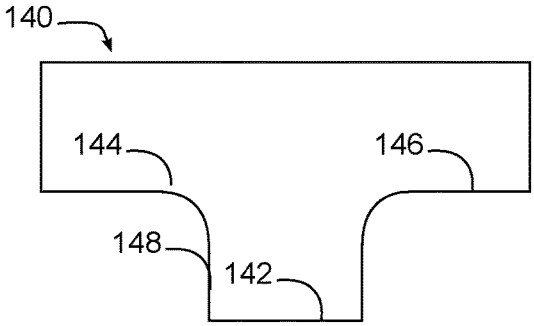
Figure 8:
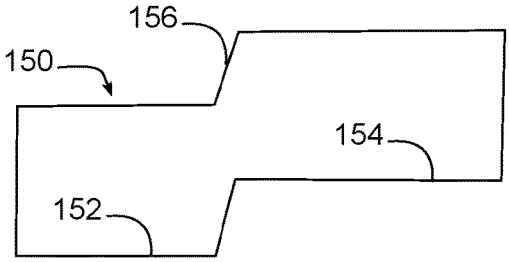

FIGS. 6-8, for example, illustrate a number of variations that may be employed in a multi-level rack consistent with the invention. FIG. 6, for example, illustrates a multi-level rack 130 including a single central shallow portion 132 and multiple side deep portions 134, 136. Furthermore, while an intermediate wall 138 is disposed between shallow portion 132 and deep portion 134, no intermediate wall is disposed between shallow portion 132 and deep portion 136, with the bottom of the rack generally inclined to join portions 132, 136. Note that despite the fact that the junctions of portions 132, 136 and 138 do not form 90 degree angles, a pair of corners are nonetheless defined proximate these junctions to permit a sprayer to spray both horizontally and vertically to impact different utensils disposed in the different shallow and deep portions.

FIG. 7, as another example, illustrates a multi-level rack 140 including a single central deep portion 142 disposed between multiple side shallow portions 144, 146. Substantially vertical intermediate walls 148 separate these portions; however, the intermediate walls curve proximate the shallow portions 144 rather than form discrete junctions. Again, however, a pair of corners are still defined to permit a sprayer to spray both horizontally and vertically to impact different utensils disposed in the different shallow and deep portions.

FIG. 8, as yet another example, illustrates a multi-level rack 150 including a single deep portion 152 and a single shallow portion 154. However, unlike the preceding examples that define a top edge of a rack at a single elevation, rack 150 illustrates how a top edge 156 can also be multi-level in some embodiments, so it will be appreciated that a multi-level rack need not have a single elevation top edge. It will also be appreciated that the configuration of a top edge of a rack, as with the bottom of a rack, may be configured in connection with other structures in a dishwasher, e.g., any racks disposed above or below the rack, or any sprayers disposed within the dishwasher, to optimize spatial utilization within the dishwasher.

Figure 9:
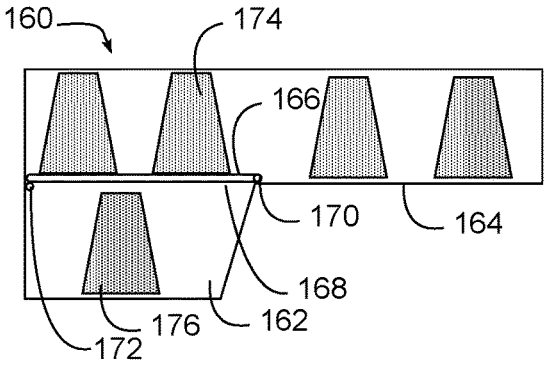
FIGS. 9 and 10 are functional front elevation views of an example implementation of a multi-level dishwasher rack incorporating a movable divider and consistent with some embodiments of the invention.
Figure 10:
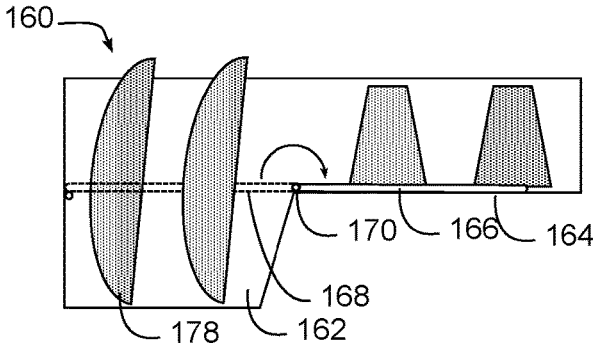

Now turning to FIGS. 9-10, it may also be desirable in some embodiments to incorporate a movable divider into a multi-level dishwasher rack in order to further increase flexibility and spatial utilization, effectively providing different configurations of a multi-level dishwasher rack that are suitable for different combinations of utensils. FIG. 9, for example, illustrates a multi-level dishwasher rack 160 including a deep portion 162, a shallow portion 164 and a movable divider 166 that, in one position, extends across at least a portion of an opening 168 across deep portion 162. In the illustrated embodiment, movable divider 166 is secured to rack 160 by a substantially horizontal hinge 170 and spans a full width of opening 168 such that the free end of the divider may be supported on a support structure 172, e.g., a horizontal bar. In this configuration, divider 166 is capable of supporting one or more utensils 174, while also permitting one or more additional utensils 176 to be supported by the lower portion of the bottom of the rack underneath the divider within deep portion 162.

Movable divider 166 in the illustrated embodiment is pivotable about a substantially horizontal axis defined by hinge 170, and as illustrated in FIG. 10, may be moved to a different position, e.g., to a position that overlays at least a portion of the upper portion of the bottom of the rack, that exposes opening 168 to enable one or more utensils 178 that extend above the opening to be supported in deep portion 162, and which otherwise would not fit beneath the divider when the divider is disposed in the position illustrated in FIG. 9. Thus, based upon whether a particular sizes and types of utensils that a consumer wishes to wash in a given load, divider 166 may be moved to either of the positions illustrated in FIG. 9 and FIG. 10 to optimize the spatial utilization in the rack.

In the illustrated embodiment, divider 166 may be planar and may define a substantially horizontal support surface. However, the invention is not limited to such a configuration, and as such, divider 166 may incorporate different profiles, e.g., including angles or tines configured to support different types of utensils. Divider 166 may be constructed of similar materials to other structural components in rack 160 (e.g., coated wire), or using other materials as will be appreciated by those of ordinary skill having the benefit of the instant disclosure. Moreover, while divider 166 is illustrated as extending at a substantially similar elevation to the portion of the rack bottom in shallow portion 164 of rack 160 such that, when in the configuration illustrated in FIG. 9 the divider and shallow portion extend at a common elevation, in other embodiments the divider may be at a higher or lower elevation and/or may have different shapes and/or inclinations.

In the embodiment of FIGS. 9 and 10, the horizontal axis defined by hinge 170 extends along a border between deep and shallow portions 162, 164, and the divider has sufficient length to span the entire opening 168, in part to that the free end of the divider can be supported by support structure 172. In other embodiments, however, a movable divider may be anchored to different structures and/or may span only a portion of opening 168, whether considered transverse to the axis of the hinge (i.e., across the width of the rack) or parallel to the axis of the hinge (i.e., from front to back in the rack). Moreover, hinge 170 may extend in other directions, e.g., such that a divider is pivotable about an axis that extends laterally across a rack. Hinge 170 may also be configured in different manners, and may, in some instances, be implemented by one or more plastic snap on fittings that partially circumscribe a coated wire forming the bottom of the rack and permit rotational movement of the divider. Further, the free end of the divider may include one or more hooks that snap onto support structure 172 to lock the divider into place when desired.

Figure 11:
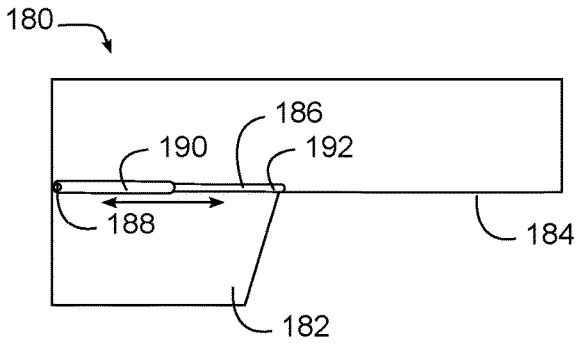
FIGS. 11 and 12 are functional front elevation views of another example implementation of a multi-level dishwasher rack incorporating a movable and extendible divider and consistent with some embodiments of the invention.
Figure 12:
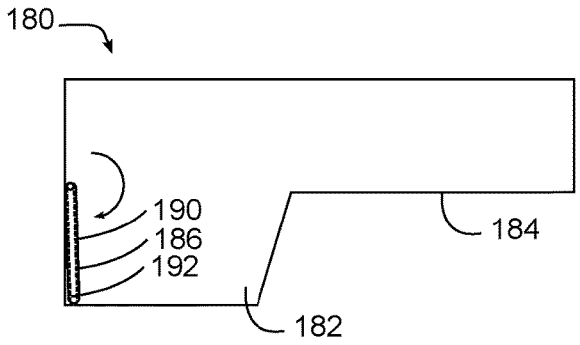

In addition, as illustrated in FIGS. 11-12, a divider may be secured in other locations and/or may be formed of multiple panels capable of being selectively extended. In particular, as one example, a multi-level rack 180 is illustrated in FIG. 11, including a deep portion 182, shallow portion 184 and a movable divider 186 that is anchored along a side wall of the rack by a hinge 188. Divider 186 is extendible and includes first and second panels 190, 192 that slide relative to one another to span a full width of an opening across deep portion 182. When it is desirable to expose the opening and enable taller utensils to be supported in deep portion 182, however, and as illustrated in FIG. 12, panels 190, 192 may slide together to shorten the divider 186, and divider 186 may be pivoted downwardly into deep portion 182 to expose the opening. Thus, in different embodiments, a divider may be secured at a different location, a divider may or may not be extendible, and/or a divider may pivot either upwardly or downwardly when exposing an opening over a deep portion of a rack.

Figure 13:
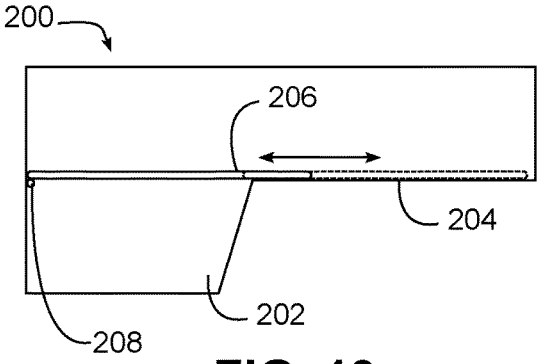
FIG. 13 is a functional front elevation view of another multi-level dishwasher rack incorporating a slidable divider and consistent with some embodiments of the invention.

In addition, as illustrated in FIG. 13, rather than being pivotable, a movable divider may also move linearly in some embodiments. In particular a rack 200 is illustrated including a deep portion 202, a shallow portion 204, and a movable divider 206 that is slidable between a position extending across an opening in deep portion 202, e.g., to be supported by a support structure 208. When exposing the opening to permit taller utensils to be supported in the deep portion, however, divider 206 may be pushed from the left to the right of the figure to at least partially overlay shallow portion 204 and expose the opening. It will also be appreciated that such a configuration may enable a divider to be moved to different positions in some embodiments based upon consumer needs, with the divider cantilevered over the opening and unsupported at its free end.

In still other embodiments, a movable divider may be fully removable from a rack and either removed from the dishwasher completely when not needed, or stored elsewhere in the dishwasher. For example, in some embodiments, divider 206 of FIG. 13 may simply snap into position across deep portion 202 when desired, and when not needed, separated from the rack, and optionally snapped into a different position overlaying shallow portion 204.

Figure 14:
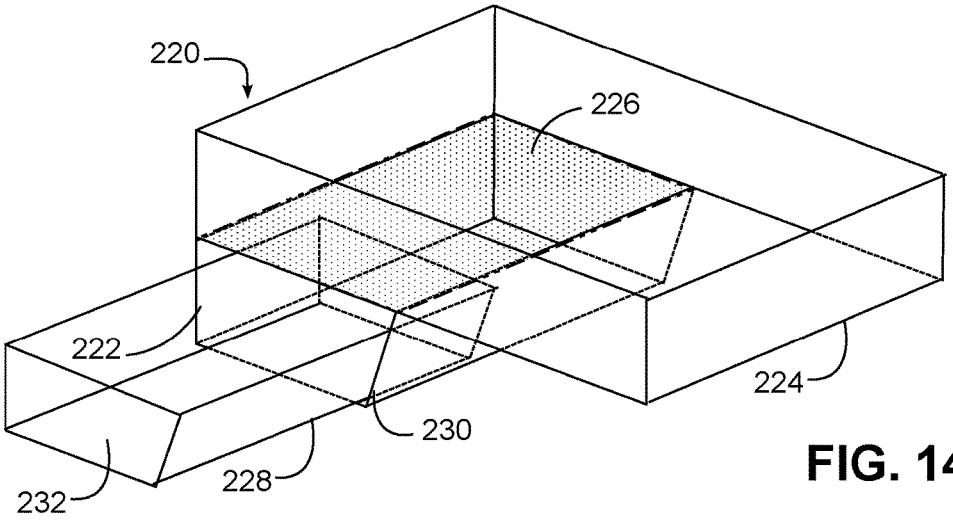
FIG. 14 is a functional perspective view of another multi-level dishwasher rack incorporating a slidable drawer and consistent with some embodiments of the invention.

Now turning to FIG. 14, a multi-level dishwasher rack in some embodiments may include a drawer for use in accessing utensils supported in a deep portion of the rack, e.g., disposed beneath a divider that spans at least a portion of an opening across the deep portion of the rack. FIG. 14, in particular, illustrates a multi-level dishwasher rack 220 including a deep portion 222, a shallow portion 224 and a divider 226 that extends across the deep portion 222. A drawer 228 is slidably received in deep portion 222, e.g., through an opening 230, and includes a bottom wall 232 capable of supporting one or more utensils. In some embodiments, bottom wall 232 may be used in addition to a lower portion of the bottom of rack 220 that defines deep portion 222, while in other embodiments, bottom 232 may itself form the lower portion of the bottom of the rack within the deep portion 222.

Drawer 228 provides access to utensils that, during washing, are disposed in deep portion 222 but underneath divider 226. In some instances, divider 226 may be fixed, such that divider is permanently formed across deep portion 222. In other embodiments, however, divider 226 is a movable divider such as any of the various movable dividers discussed above in connection with FIGS. 9-13. By combining a movable divider with a drawer, taller utensils may be supported in deep portion 222 when desired, yet when the movable divider is positioned across the deep portion, utensils supported beneath the movable divider are still accessible to a consumer without having to move the movable divider (which may have other utensils supported thereon).

Next, as illustrated in FIGS. 15-20, it may also be desirable to utilize one or more movable portions of a rack bottom in a multi-level dishwasher rack to provide different supporting elevations and thereby enable a rack to be customized by a consumer to effectively utilize different combinations of deep and shallow portions based upon the particular utensils that a consumer may wish to wash in a given load. In some embodiments, for example, it may be desirable to configure a bottom of a multi-level dishwasher rack to include a fixed portion and one or more movable portions that are movable relative to the fixed portion. The fixed portion of the bottom may be configured to support one or more utensils at a predetermined elevation and each movable portion may be movable between first and second configurations, such that when a movable portion is in the first configuration the movable portion is configured to support one or more utensils at a first elevation and when the movable portion is in the second configuration the movable portion is configured to support one or more utensils at a second elevation that is different from the first elevation. In some instances, the first or second elevation may be substantially similar to the predetermined elevation, while in other instances, each of the first and second elevations may be different from the predetermined elevation.

Figure 15:
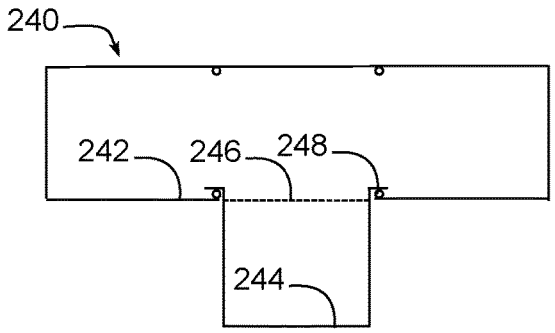
FIGS. 15 and 16 are functional front elevation views of an example implementation of a multi-level dishwasher rack incorporating a movable portion consistent with some embodiments of the invention.
Figure 16:
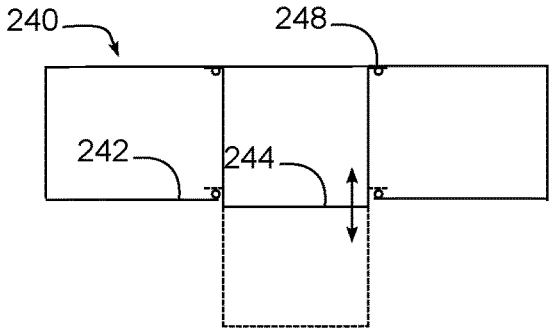

As illustrated in FIGS. 15 and 16, for example, in some embodiments a multi-level dishwasher rack 240 may include a bottom with a fixed portion 242 and a movable portion 244 that is movable linearly in a generally vertical direction. In this example, movable portion 244 is configured as a basket, and may include one or more side walls in some embodiments, while in other embodiments, the movable portion may only include a horizontal platform that hangs from one or more support members. As illustrated in FIG. 15, movable portion 244 may extend through an opening 246 in fixed portion 242 and hang from one or more support structures 248 circumscribing the opening. In such a configuration, a deep portion is formed in rack 240 to support taller utensils. Then, as illustrated in FIG. 16, if it is not desirable to support taller utensils in rack 240, movable portion 244 may be lifted vertically (and slid linearly) and engage with one or more support structures 250, such that the entire rack has a single shallow portion, and such that additional space is provided underneath the rack (e.g., to provide room for taller utensils on a lower rack).

Figure 17:
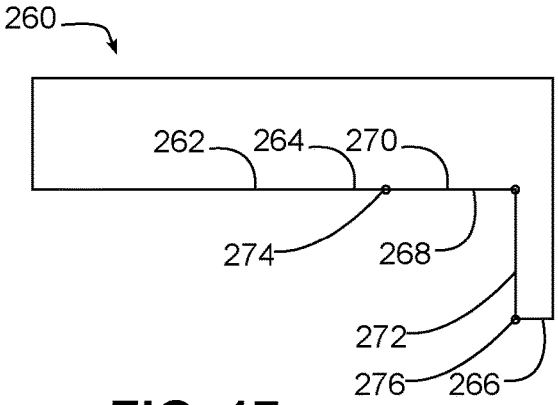
FIGS. 17 and 18 are functional front elevation views of another example implementation of a multi-level dishwasher rack incorporating a movable portion consistent with some embodiments of the invention.
Figure 18:
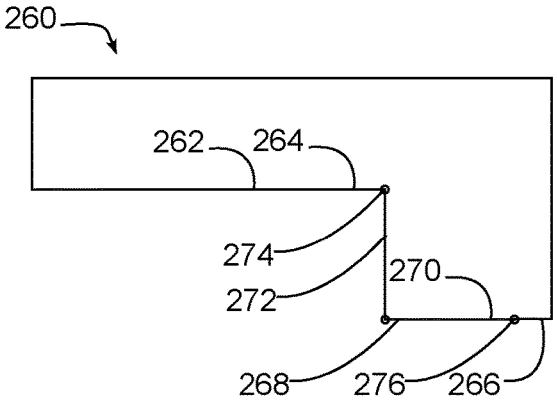

As another example, FIGS. 17 and 18 illustrate another multi-level dishwasher rack 260 that includes a bottom wall 262 including one fixed portion 264 defining a shallow portion of the rack and another fixed portion 266 defining a deep portion of the rack. In addition, a movable portion 268 is provided, and includes a pair of orthogonal members 270, 272 that respectively extend in substantially horizontal and vertical directions, and that can be configured in two different configurations, a first (illustrated in FIG. 17) where one side of member 270 is facing upwardly and positioned at a similar elevation to fixed portion 264 to effectively extend the shallow portion of the rack, and a second (illustrated in FIG. 18) where an opposite side of member 270 is facing upwardly and positioned at a similar elevation to fixed portion 266 to effectively extend the deep portion of the rack.

In one embodiment, member 270 is a support member and movable portion 268 is slidably coupled to rack 260 along a pair of rails 274, 276 to slide in a generally horizontal direction (e.g., in and out of the direction of the page). Further, movable portion 268 is fully removable from the rack to permit the movable portion to be installed in the two different configurations illustrated in FIGS. 17 and 18.

Figure 19:
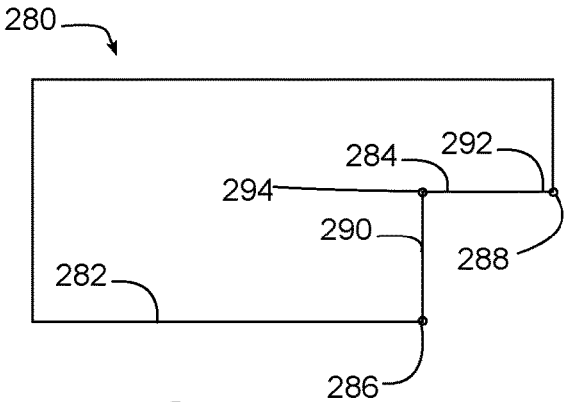
FIGS. 19 and 20 are functional front elevation views of another example implementation of a multi-level dishwasher rack incorporating a movable portion consistent with some embodiments of the invention.
Figure 20:
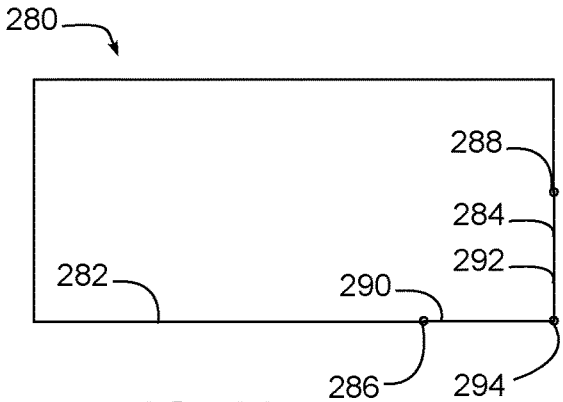

Alternately, and as illustrated in FIGS. 19 and 20, rather than utilizing a movable portion that is slidably received by the rack, a movable portion in some embodiments may be formed of one or more movable components that are not removably coupled to the rack. FIG. 19, for example, illustrates a multi-level dishwasher rack 280 including a bottom with a fixed portion 282 and a movable portion 284 that is secured to rack 280 via a pair of hinges 286, 288. In this embodiment, movable portion 284 includes a pair of movable members 290, 292 pivotably secured to hinges 286, 288, with each movable member 290, 292 being pivotable between at least substantially horizontal and substantially vertical orientations.

In this embodiment, movable members 290, 292 are removably coupled to one another, e.g., via a removable coupling 294 such as one or more snap fittings, such that the movable members may be separated from one another, pivoted between horizontal and vertical orientations, and then reattached to one another to switch between different configurations. Specifically, as illustrated in FIG. 19, in one configuration movable member 290 is oriented substantially vertically and movable member 292 is oriented substantially horizontally, thereby forming a support surface that effectively defines a shallow portion of the rack. By separating movable members 290, 292 from one another, pivoting movable member 290 to a horizontal orientation, pivoting movable member 292 to a vertical orientation, and reattaching the movable members 290, 292 to one another, the movable portion is reconfigured into the configuration illustrated in FIG. 20, where movable member 290 forms a support surface that effectively is an extension of the deep portion of the rack formed by fixed portion 282.

It should be noted that rather than utilizing hinges 286, 288 and a removable coupling 294 to join movable members 290, 292, movable members 290, 292 may be coupled to one another via a non-removable coupling, and may be pivotable relative to one another (e.g., via a hinge). In such an embodiment, a removable coupling may be provided between a free end of one of movable members 290, 292 and the rack itself. By way of example, in some embodiments, hinge 286 or hinge 288 may be swapped with removable coupling 294. Furthermore, in different embodiments, removable couplings may function as hinges, so hinges are not limited to non-removable and non-separable mechanical arrangements, and thus any combination of hinges and/or removable couplings may be used in various embodiments. Still further mechanical arrangements may be used to reconfigure a movable portion of a rack bottom in other embodiments, as will be appreciated by those of ordinary skill having the benefit of the instant disclosure.

In addition, with reference to each of FIGS. 17-20, it should be appreciated that various combinations of fixed and movable portions of a rack bottom may be used in different embodiments to support different combinations of deep and shallow portions of a rack. The arrangement illustrated in FIGS. 17-18, for example, effectively increases or decreases the sizes of single deep and shallow portions of a rack, while the arrangement illustrated in FIGS. 19-20 effectively adds or removes a shallow portion of a rack that is otherwise configured with a single elevation. Moreover, while the arrangement of FIGS. 17-18 is disclosed as using a movable portion that is slidably attached to and detached from a rack in different configurations, while the arrangement of FIGS. 19-20 is disclosed as using multiple movable members that are reconfigured by pivoting the movable members to different orientations, it will be appreciated that the movable portion of FIGS. 17-18 may be used in the arrangement of FIGS. 19-20 and that the movable portion of FIGS. 19-20 may be used in the arrangement of FIGS. 17-18 in other embodiments.

Figure 21:
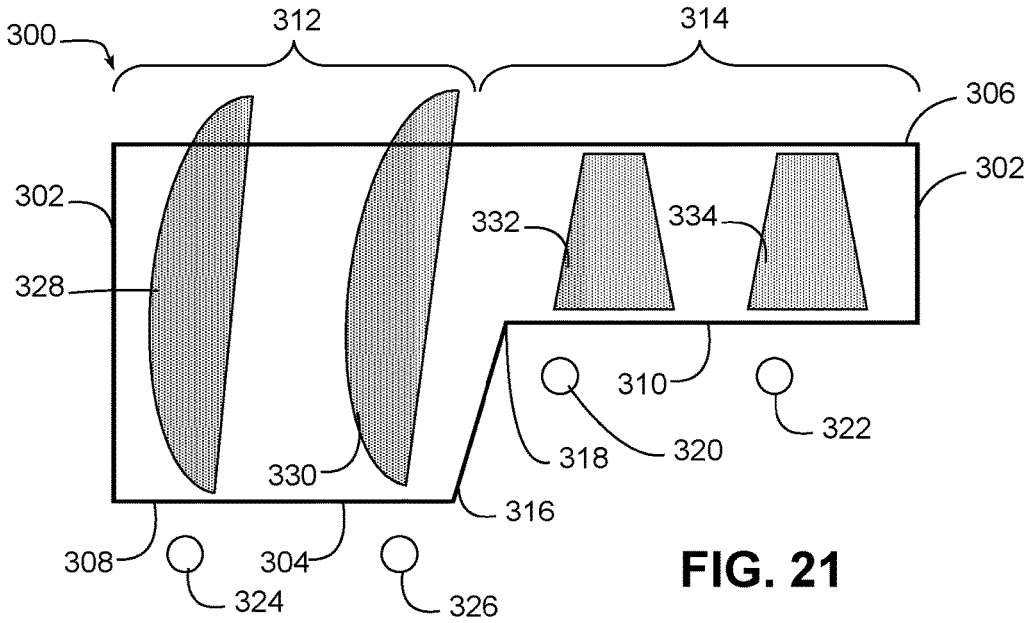
FIG. 21 is a functional front elevation view of an example implementation of a multi-level dishwasher rack and a plurality of tubular spray elements consistent with some embodiments of the invention.
Figure 22:
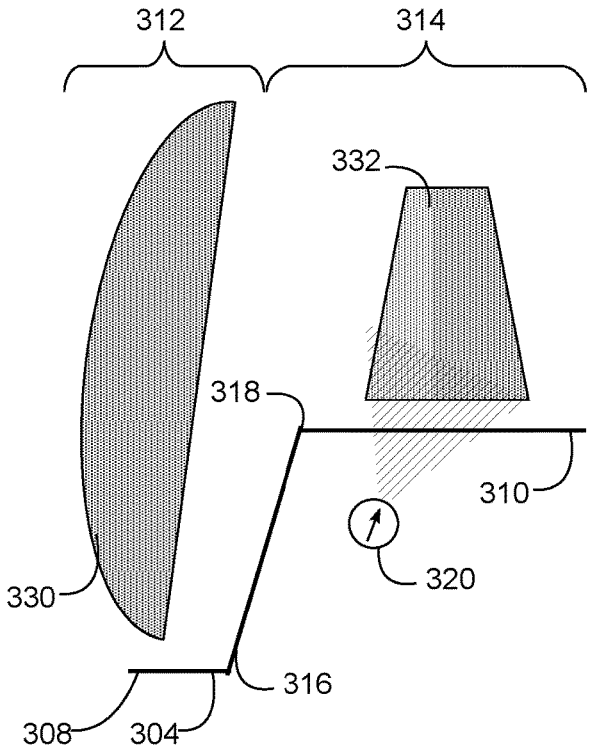
FIGS. 22 and 23 are partial enlarged views of the multi-level dishwasher rack of FIG. 21, and illustrating upward and lateral spray directions for a tubular spray element disposed proximate a corner between shallow and deep portions of the rack.
Figure 23:
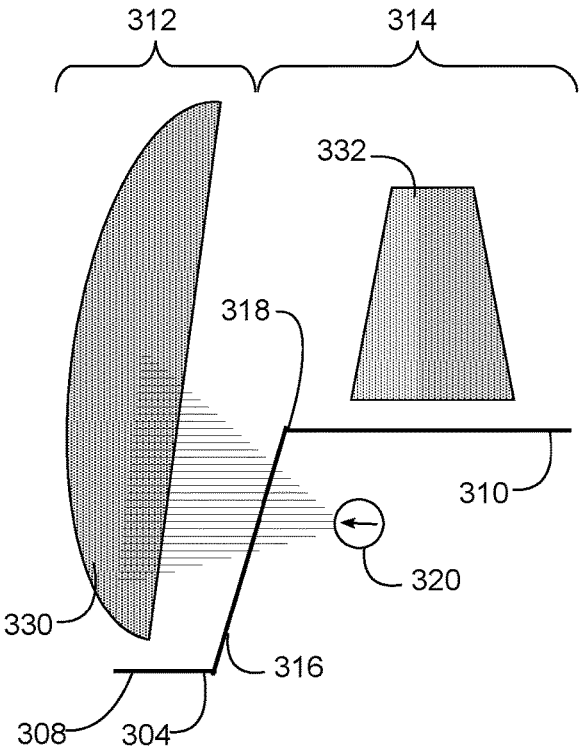

Now turning to FIGS. 21-23, another advantage of a multi-level dishwasher rack in some embodiments is that such a rack may be configured to present different types of utensils at different orientations and elevations to optimize cleaning of those utensils using various types of sprayers, in particular rotatable spray tubes, including rotatable spray tubes implemented as discretely-directable tubular spray elements. FIG. 21, for example, illustrates an example multi-level dishwasher rack 300 including a plurality of side walls 302, a bottom 304 and a top edge 306. Bottom 304 includes a lower portion 308 and an upper portion 310 that respectively define deep and shallow portions 312, 314 of the rack, and an intermediate wall 316 joins the lower and upper portions 308, 310 and forms a corner 318 at the junction of intermediate wall 316 and upper portion 310.

In addition, a plurality of rotatable spray tubes 320, 322, 324 and 326 are positioned underneath rack 300, with rotatable spray tubes 320 and 322 positioned underneath shallow portion 314 and rotatable spray tubes 324, 326 positioned underneath deep portion 312. In the illustrated embodiment, each of rotatable spray tubes 320, 322, 324, 326 is implemented as a discretely-directable tubular spray element such as described above in connection with FIG. 3. However, in other embodiments, one or more of the rotatable spray tubes may not be discretely directable, and may, for example, rotate or oscillate via electric or hydraulic motor control or in reaction to the exit of fluid therefrom.

It will be appreciated that, similar to other types of sprayers such as rotatable spray arms that are fan-shaped and rotate about a vertical axis, each of rotatable spray tubes 320-326 may direct fluid upwardly into rack 300 through bottom 304, e.g., to wash downwardly-facing surfaces of utensils such as utensils 328, 330 in deep portion 312 and utensils 332, 334 in shallow portion 314. However, at least with respect to rotatable spray tube 320, this rotatable spray tube is positioned proximate corner 318, and as such, is also positioned suitably for directing fluid laterally into rack 300 and towards deep portion 312 of rack 300 to spray a laterally-facing surface of a different utensil supported in the deep portion of the rack.

FIGS. 22 and 23, for example, illustrate these two different directions of spray. FIG. 22, for example, illustrates rotatable spray tube 320 pointing in a generally upward or vertical direction to spray fluid upwardly, through upper portion 310 of bottom 304 and onto a downwardly-facing surface of utensil 332 supported in shallow portion 314. FIG. 23 illustrates rotatable spray tube 320 pointing in a generally lateral or horizontal direction to spray fluid laterally, through intermediate wall 316 and onto a laterally-facing surface of utensil 330 supported in deep portion 312.

It will also be appreciated that when a rotatable spray tube 320-326 is implemented as a discretely-directable tubular spray element, a controller that controls the direction of each tubular spray element may be configured to vary the direction, speed and/or dwell time of each tubular spray element to optimize washing of different types of utensils, including based upon user or machine-selected settings. For example, where a pots and pans cycle or option is selected, it may be desirable to focus a tubular spray element to provide concentrated washing of a pot or pan that is positioned in the manner illustrated by utensil 330 in FIG. 23 to optimize washing of a cooking surface of the utensil. Conversely, where a glassware cycle or option is selected, it may be desirable to focus a tubular spray element to provide concentrated washing of glassware that is positioned in the manner illustrated by utensil 332 in FIG. 22 to optimize washing of glassware disposed in the rack. Further, in embodiments where an imaging device is used to detect the placement and/or types of utensils disposed in a rack, the direction of different tubular spray elements may be optimized to wash each of the utensils disposed in a rack. Moreover, at other times during a wash cycle, any of rotatable spray tubes 320-326 may be directed downwardly in some embodiments to spray utensils disposed in a lower rack, or even to focus spray on particular regions of a lower rack, e.g., a silverware basket.

Other modifications may be made to the illustrated embodiments without departing from the spirit and scope of the invention. Various additional modifications may be made to the illustrated embodiments consistent with the invention. Therefore, the invention lies in the claims hereinafter appended.

What is claimed is:

1. A dishwasher, comprising:

a wash tub;

a fluid supply configured to supply fluid to the wash tub;

a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, the deep portion of the rack sized to receive taller utensils than the shallow portion of the rack;

a tubular spray element disposed in the wash tub proximate the rack and being rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures; and a tubular spray element drive coupled to the tubular spray element and configured to discretely direct the tubular spray element to each of a plurality of rotational positions about the longitudinal axis thereof, the tubular spray element drive configured to discretely direct the tubular spray element to direct fluid upwardly into the rack from beneath the upper portion of the bottom of the rack to spray a downwardly-facing surface of a first utensil supported in the shallow portion of the rack, and to discretely direct the tubular spray element to direct fluid laterally into the rack and towards the deep portion of the rack to spray a laterally-facing surface of a second utensil supported in the deep portion of the rack.

2. The dishwasher of claim 1, wherein the bottom of the rack further includes an intermediate wall extending between the upper and lower portions and in a generally transverse direction, a junction between the intermediate wall and the upper portion of the bottom of the rack forming a corner, wherein the tubular spray element is disposed proximate the corner, and wherein the tubular spray element directs fluid through the intermediate wall when spraying the laterally-facing surface of the second utensil.

3. The dishwasher of claim 2, wherein the intermediate wall extends in a substantially vertical direction.

4. The dishwasher of claim 1, wherein the tubular spray element is a first tubular spray element, the dishwasher further comprising:

a second tubular spray element disposed in the wash tub underneath the upper portion of the bottom of the rack and positioned to spray upwardly into the rack from beneath the upper portion of the bottom of the rack;

a third tubular spray element disposed in the wash tub underneath the lower portion of the bottom of the rack and positioned to spray upwardly into the rack from beneath the lower portion of the bottom of the rack.

5. The dishwasher of claim 1, wherein the tubular spray element is mounted to a wall of the wash tub.

6. The dishwasher of claim 1, wherein the tubular spray element is supported by the rack.

7. The dishwasher of claim 1, further comprising a controller coupled to the tubular spray element drive, the controller configured to, during a portion of a wash cycle, control the tubular spray element drive to discretely direct the tubular spray element to direct fluid upwardly into the rack from beneath the upper portion of the bottom of the rack to provide concentrated washing of the downwardly-facing surface of the first utensil.

8. The dishwasher of claim 1, further comprising a controller coupled to the tubular spray element drive, the controller configured to, during a portion of a wash cycle, control the tubular spray element drive to discretely direct the tubular spray element to direct fluid laterally into the rack and towards the deep portion of the rack to provide concentrated washing of the laterally-facing surface of the second utensil.

9. A dishwasher, comprising:

a wash tub;

a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, the deep portion of the rack sized to receive taller utensils than the shallow portion of the rack, and the deep portion of the rack further defining an opening at least partially circumscribed by the upper portion of the bottom of the rack; and a movable divider disposed in the rack and movable between first and second positions, wherein in the first position, the divider extends across at least a portion of the opening to support one or more utensils on the divider while permitting one or more utensils to be supported by the lower portion of the bottom of the rack underneath the divider, and in the second position, the divider exposes the opening to support one or more utensils that extend above the opening when the divider is located when in the first position, wherein the divider is sized to fully span the opening when in the first position.

10. The dishwasher of claim 9, wherein the divider is pivotable about a substantially horizontal axis.

11. The dishwasher of claim 10, wherein the divider defines a substantially planar and substantially horizontal support surface when in the first position.

12. The dishwasher of claim 11, wherein the divider is configured to extend at a substantially similar elevation to the upper portion of the bottom of the rack when in the first position.

13. The dishwasher of claim 10, wherein the substantially horizontal axis extends along a border between the deep and shallow portions of the rack.

14. The dishwasher of claim 13, wherein the rack is configured to support a free end of the divider opposite the substantially horizontal axis when the divider is in the first position.

15. The dishwasher of claim 13, wherein the divider is configured to overlay at least a portion of the upper portion of the bottom of the rack when in the second position.

16. The dishwasher of claim 9, wherein the divider is configured to extend downwardly into the deep portion of the rack when in the second position.

17. The dishwasher of claim 9, wherein the divider is slidable between the first and second positions.

18. The dishwasher of claim 9, wherein the divider is extendible to fully span the opening when in the first position.

19. The dishwasher of claim 9, further comprising a drawer slidably received by the deep portion of the rack and configured to provide access to one or more utensils supported underneath the movable divider when the movable divider is in the first position.

20. A dishwasher, comprising:

a wash tub;

a multi-level rack disposed in the wash tub and configured to support a plurality of utensils to be washed, the rack configured to move between loading and washing positions, and the rack including a bottom and a plurality of side walls, the bottom of the rack including lower and upper portions disposed at different elevations to define deep and shallow portions of the rack, a divider disposed in the rack and configured to extend across at least a portion of the deep portion of the rack to support one or more utensils on the divider; and a drawer slidably received by the deep portion of the rack and configured to provide access to one or more utensils underneath the divider.

21. The dishwasher of claim 20, wherein the deep portion of the rack is sized to receive taller utensils than the shallow portion of the rack, and the deep portion of the rack further defines an opening at least partially circumscribed by the upper portion of the bottom of the rack, wherein the divider is a movable divider that is movable between first and second positions, wherein in the first position, the divider extends across at least a portion of the opening to support one or more utensils on the divider while permitting one or more utensils to be supported by the lower portion of the bottom of the rack underneath the divider, and in the second position, the divider exposes the opening to support one or more utensils that extend above the opening when the divider is located when in the first position.

22. The dishwasher of claim 20, wherein the drawer includes a bottom wall configured to support one or more utensils.

23. The dishwasher of claim 20, wherein the divider is disposed at a substantially similar elevation as the upper portion of the bottom of the rack.

24. The dishwasher of claim 20, wherein the drawer defines the lower portion of the bottom of the rack.

* * * * *